US008616034B2

(12) United States Patent
Tuschhoff

(10) Patent No.: US 8,616,034 B2
(45) Date of Patent: Dec. 31, 2013

(54) METHOD FOR CONTROLLING SIDE GUIDES OF A METAL STRIP

(75) Inventor: Matthias Tuschhoff, Siegen (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 13/519,979

(22) PCT Filed: Dec. 23, 2010

(86) PCT No.: PCT/EP2010/070698
§ 371 (c)(1),
(2), (4) Date: Jul. 16, 2012

(87) PCT Pub. No.: WO2011/080226
PCT Pub. Date: Jul. 7, 2011

(65) Prior Publication Data

US 2012/0267415 A1 Oct. 25, 2012

(30) Foreign Application Priority Data

Dec. 29, 2009 (DE) ..... 10 2009 060 823

(51) Int. Cl.
*B21B 37/00* (2006.01)

(52) U.S. Cl.
USPC ..... 72/10.4; 72/10.1; 72/250

(58) Field of Classification Search
USPC ..... 72/8.1, 10.1, 10.4, 13.1, 12.1, 13.2, 72/13.3, 234, 250, 226, 227, 13.4, 14.4, 72/14.1, 14.5, 9.3, 1.9; 700/148, 150
See application file for complete search history.

(56) References Cited

U.S. PATENT DOCUMENTS

| | | | | |
|---|---|---|---|---|
| 4,590,778 | A | 5/1986 | Klockner et al. | |
| 4,643,013 | A | 2/1987 | Blazevic | |
| 5,077,997 | A * | 1/1992 | Wolters et al. | 72/9.2 |
| 5,284,284 | A | 2/1994 | Narishima et al. | |

(Continued)

FOREIGN PATENT DOCUMENTS

| | | | | |
|---|---|---|---|---|
| DE | 3240692 | A1 * | 5/1984 | B21B 39/14 |
| DE | 4003717 | A1 | 8/1991 | |
| DE | 4310547 | C2 | 3/1994 | |
| DE | 4129988 | C2 | 10/1996 | |
| DE | 4003717 | | 5/1999 | |
| GB | 2271071 | A | 4/1994 | |
| JP | 60247407 | A | 12/1985 | |

(Continued)

*Primary Examiner* — Dana Ross
*Assistant Examiner* — Pradeep C Battula
(74) *Attorney, Agent, or Firm* — Lucas & Mercanti, LLP; Klaus P. Stoffel

(57) ABSTRACT

The invention relates to a method for controlling a side guide of a metal strip (1), in particular in the inlet or outlet of roll stands or driving apparatuses, wherein the side guide comprises a guide (2, 4) disposed laterally to the metal strip (1) on both sides of the metal strip (1), and the guides (2, 4) can be displaced independently of each other. One of the guides (2) is thereby driven by means of position control, and a second of the guides (4) is driven by means of force control, wherein forces of the metal strip (1) acting on the first guide (2) and the second guide (4) are measured. The target force for the second, force-controlled guide (4) is thereby prescribed as a function of the measured force on the first, position-controlled guide (2), wherein as the force on the first, position-controlled guide (2) increases, the target force for the second, force-controlled guide (4) is reduced. In particular, damage to the guides (2, 4) and to the metal strip (1) can be prevented or at least reduced by means of said type of controlling.

10 Claims, 3 Drawing Sheets

(56) References Cited

U.S. PATENT DOCUMENTS

| | | | | |
|---|---|---|---|---|
| 6,000,259 | A * | 12/1999 | Wolters et al. | 72/13.3 |
| 6,308,547 | B1 * | 10/2001 | Heess et al. | 72/107 |
| 2006/0144831 | A1 * | 7/2006 | Schmidt et al. | 219/121.72 |
| 2008/0141668 | A1 * | 6/2008 | Micklisch | 72/350 |

FOREIGN PATENT DOCUMENTS

| | | | |
|---|---|---|---|
| JP | 63040615 | A | 2/1988 |
| JP | 2235519 | | 9/1990 |
| JP | 5285521 | A | 11/1993 |
| JP | 2001047120 | | 2/2001 |

* cited by examiner

METHOD FOR CONTROLLING SIDE GUIDES OF A METAL STRIP

The present application is a 371 of International application PCT/EP2010/070698, filed Dec. 23, 2010, which claims priority of DE 10 2009 060 823.0, filed Dec. 29, 2009, the priority of these applications is hereby claimed and these applications are incorporated herein by reference.

BACKGROUND OF THE INVENTION

The invention pertains to a method for controlling the lateral guides for a metal strip, especially at the entrance or exit from rolling stands in rolling mills, for example; they can also be used in front of drive apparatus or in other strip processing lines.

Methods for automatically controlling the lateral guides for a metal strip are already known from the prior art. Such guides usually consist of two straightedges, one on each side of the strip, which are positioned by hydraulic cylinders and which can be pressed or tightened against the strip as the strip passes by. The known systems frequently also comprise a mechanical connection between the two straightedges as well as a common control system for their adjustment. Although systems of this type are relatively simple to design, the ability to adjust and to control them is very limited. Not all variations in the course of the strip can be adequately corrected, and damage to the metal strip and to the straightedges cannot always be adequately avoided.

Methods are also known in which, while a strip is passing through the guide, one of the straightedges can be operated under automatic position control, while other is pressed with a defined force against the strip. In this method, the pressing force between the straightedge and the strip is determined for both sides. While the strip is passing through the guide, the straightedge on one side is maintained in a fixed position under automatic position control. The other straightedge is pressed with a defined force against the strip under automatic force control. The nominal force of the force-controlled straightedge is prespecified as a function of the properties of the strip to be guided such as its material, width, thickness, temperature, or speed. This nominal force is selected in such a way that it is greater in all cases than the contact force of the strip on the force-controlled side, because otherwise the guide could be opened on this side by the strip. A disadvantage of this method is that, when the strip exerts a force on the position-controlled side, both this force of reaction and the prespecified force exerted by the force-controlled side must be absorbed on the position-controlled side. This leads to damage to the strip and also to the straightedges. To repair the straightedges, long system shut-downs are unavoidable. Another disadvantage of the method derives from the fact that the width of the strip to be guided is usually not constant. Because a fixed nominal force is prespecified independently of the width of the strip to be guided, the straightedges cannot be adequately adjusted to various changes in the width of the strip, as a result of which the guidance is poor in the best of cases or the forces between the strip and the straightedges are so high that considerable damage occurs.

Laid Open Application No. DE 4003717 A1 discloses another method for the lateral guidance of a strip for rolling. The goal of the disclosed method is to increase the service life of the straightedges in a roller table. For this purpose, an automatic control system is proposed for the straight edges which work in such a way that the guides can be pressed against the edges of the strip and moved away from them again in alternation. The disadvantage of this method is, among other things, that nominal values for an automatic force control circuit are prespecified by a process computer on the basis of an input, and as a result in many cases the automatic control cannot proceed with sufficient accuracy. Because the nominal forces are prespecified, this method suffers from the same disadvantages as those mentioned above, so that, when this method is applied, the straightedges still wear out more quickly than desired, and significant damage to the edges of the strip can occur.

The technical goal which arises from this prior art is therefore to be seen in making available an improved method for the automatic control of the lateral guides for metal strips or at least in avoiding one of the above-mentioned disadvantages.

SUMMARY OF THE INVENTION

The above technical goal is achieved by the inventive method for the automatic control of the lateral guide for a metal strip, especially at the entrance or exit of rolling stands or in front of drive apparatus, wherein the lateral guides comprise two straightedges, one arranged along each side of the metal strip; wherein the straightedges can be moved independently of each other; wherein the first straightedge is operated under automatic position control and the second straightedge under automatic force control; and wherein the forces of the metal strip acting on the first and the second straightedges are measured. According to the invention, furthermore, the nominal force of the second, force-controlled straightedge is prespecified as a function of the measured force acting on the first, position-controlled straightedge, wherein, as the force on the first, position-controlled straightedge increases, the nominal force for the second, force-controlled straightedge is decreased and/or, as the force on the first, position-controlled straightedge decreases, the nominal force for the second, force-controlled straightedge is increased. Because both straightedges are operated separately by automatic control circuits, namely, in the one case by a position-control circuit and in the other by a force-control circuit, the influence on the guidance is considerably improved. Because the nominal forces prespecified for the second straightedge are prespecified as a function of the forces measured on the first straightedge and not simply defined by material parameters alone or by an operator, the automatic control of the system is considerably improved. Less damage occurs because of the lower contact forces between the straightedges and the strip. Longer maintenance intervals and better strip quality result from the features of the inventive method. In addition, the braking effect on the strip is reduced, which decreases the amount of energy needed to transport the strip. The situation in which both the strip and the action of the force-controlled side press against the position-controlled side is also prevented. In particular, this also means that, when changes occur in the width of the strip, the straightedges can be adjusted more effectively to the widening or narrowing strip, as a result of which strips of this type can be guided more effectively and damage can be reduced.

In a preferred embodiment of the invention, the nominal force for the second, force-controlled straightedge is decreased to a prespecifiable, lower limit. As a result of this prespecifiable lower limit, it is possible in particular to ensure that the friction of the guiding straightedge is overcome. If the nominal force were to be set too low, it would no longer be possible in all cases to adjust the strip despite the tightening of the straightedge against the strip on the force-controlled side. Establishing a lower force limit thus makes it possible to improve the effectiveness of the automatic control.

In another preferred embodiment of the method, the nominal force for the second, force-controlled straightedge is determined from the parameters a, b, c, and d and from the force acting on the first, position-controlled straightedge, i.e., the actual force being exerted, by means of the equations $F_1=K1-a$ and $S2=b-c\cdot F_1$, wherein the parameters a, b, c, and d are greater than or equal to zero, and the parameter b gives the required maximum pressing force of the second, force-controlled straightedge; it is also true that $S2\geq d$ and $F_1\geq 0$, wherein $F_1$ represents an auxiliary variable. Especially advantageous control can be achieved by choosing the nominal force on the second straightedge as a function of the actual force on the side of the first, position-controlled straightedge.

In another preferred embodiment of the method, the parameter a gives a prespecifiable minimum force on the first, position-controlled straightedge. The prespecifiable parameter c, furthermore, gives the ratio of the relief of the second, force-controlled straightedge in the case of an increase in the force on the first, position-controlled straightedge. The parameter d represents the lower force limit, i.e., the limit below which the force may not fall when the nominal force for the second, force-controlled straightedge is being decreased. The quality of the control can be further improved through the appropriate choice of these parameters, which will be based on the concrete application or the on the existing mill.

In another preferred exemplary embodiment of the method, the forces measured at the first, position-controlled straightedge are filtered through a low-pass filter. Filtering with a low-pass filter filters out the high frequencies such as those caused by a disturbance; this results in a further improvement or further stabilization of the control. The control and in particular the specification of the nominal force value of the second, force-controlled straightedge thus also become insensitive to short-term fluctuations in the measured actual forces on the position-controlled side.

In another preferred embodiment of the method, the first and second straightedges are each driven by a drive, wherein at least one of these drives is designed optionally as either a hydraulic or pneumatic drive.

In another preferred embodiment of the method, the hydraulic or pneumatic drives comprise two cylinder chambers, wherein the forces acting on the first and second straightedges are determined by the pressures measured in the cylinder chambers.

In another preferred embodiment of the method, the first and second straightedges are each driven by a drive, wherein at least one of these drives is formed optionally by a linear electric motor.

In another preferred embodiment of the method, the force acting on the first or second straightedge is determined on the basis of the measured electrical variables of the linear motor. Such measurement or determination simplifies the automatic control process.

In another preferred embodiment of the method, the first and second straightedges are each driven by a drive, wherein at least one of these drives takes the form of a rotary motor and a spindle gear, the rotary motor being driven optionally either hydraulically or pneumatically.

SHORT DESCRIPTION OF THE FIGURES

The figures of the exemplary embodiments are described briefly below. Additional details can be derived from the detailed description of the exemplary embodiments.

DETAILED DESCRIPTION OF THE INVENTION

Figure 1:
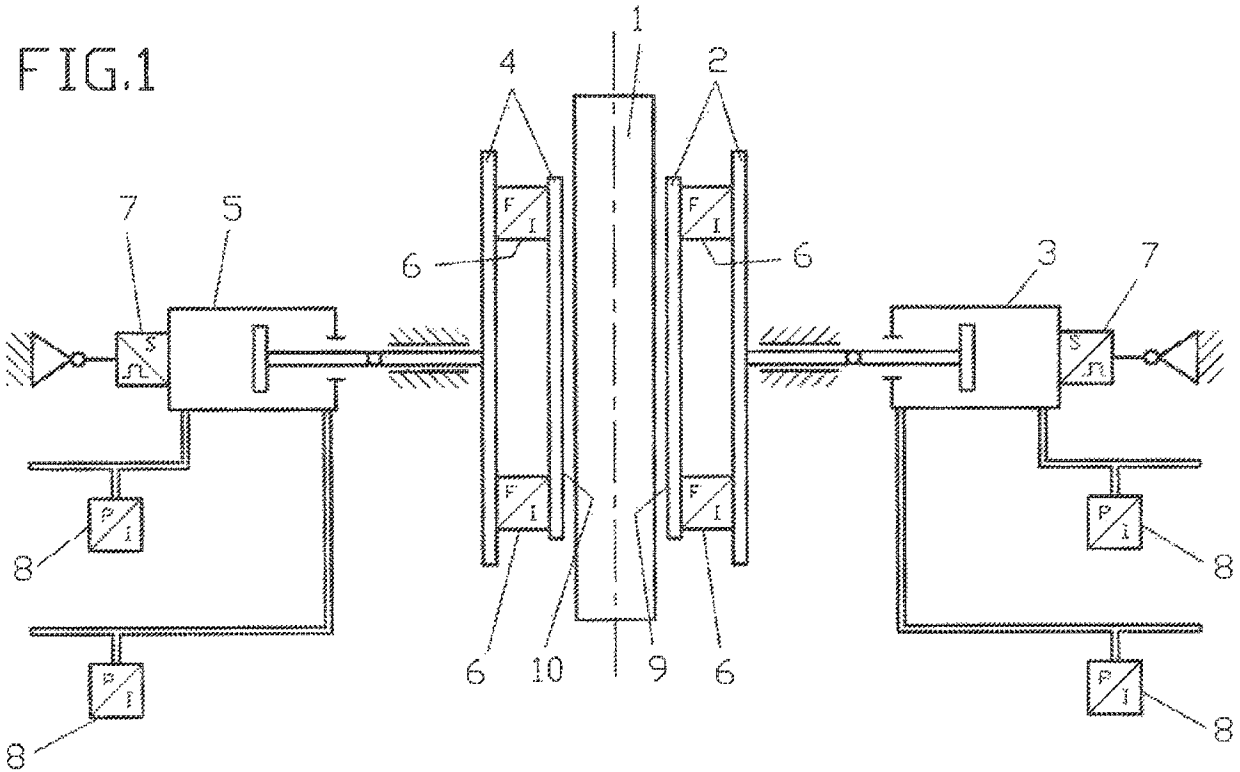
FIG. 1 shows a schematic diagram of the lateral guides for a metal strip together with the control engineering.
Figure 3:
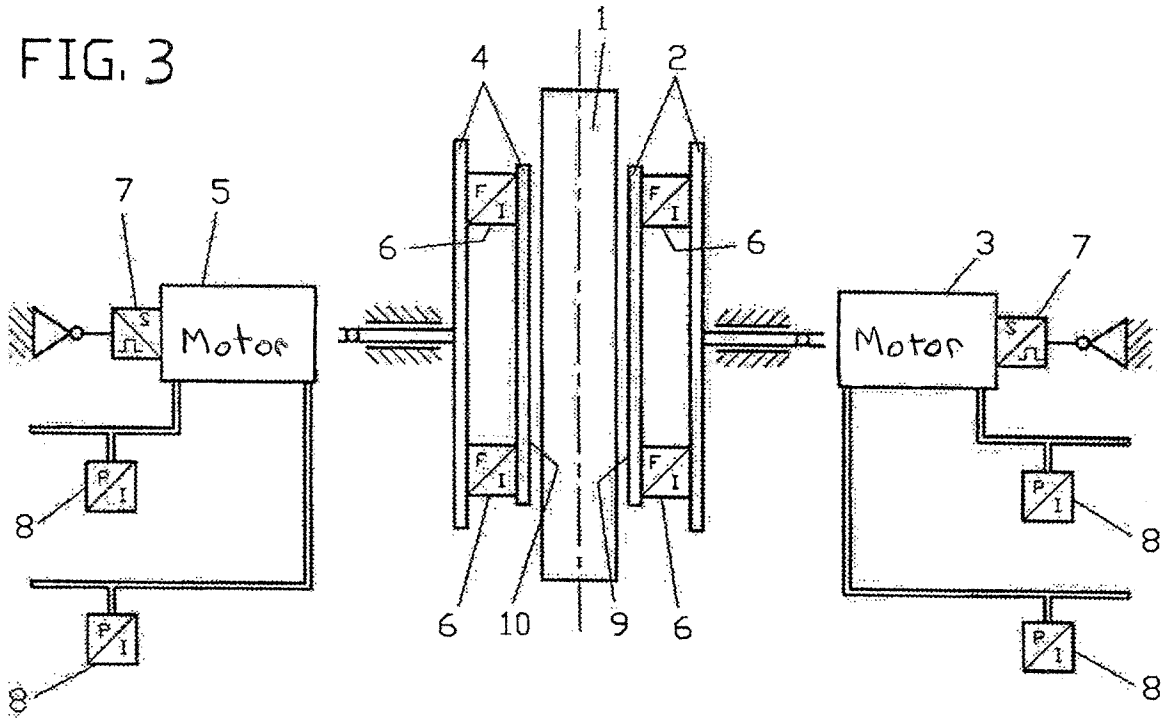
FIG. 3 is a view as on FIG. 1 schematically showing the drives as an electrical linear motor and a hydraulically or pneumatically driven rotary motor and spindle gear.

FIG. 1 shows an example of an arrangement for implementing the inventive method. A metal strip 1, preferably a steel strip 1, is guided on both sides, i.e., both long sides, by lateral guides. Each of these lateral guides, which are known in themselves, comprises a straightedge 2, 4. The metal strip 1 can be contacted by the guide edges 9, 10 of the straightedges 2, 4. The straightedges 2, 4 are preferably pressed laterally against the strip 1 by drives or pressing devices 3, 5. As shown in FIG. 1, it is also possible as an option to provide force-measuring sensors 6 between the guide edges 9, 10 and the drives or pressing devices 3, 5 of the straightedges 2, 4. It is also possible for the straightedges 2, 4 to consist of several parts, as shown. The pressing devices 3, 5 can be formed, as shown by way of example, by hydraulic or pneumatic cylinders. Position sensors 7 are also provided according to FIG. 1; these sensors can measure the distance traveled by the pistons in the pressing devices 3, 5. Alternatively, it is also possible to provide different position sensors 7 such that, for example, they determine the position of the straightedges 2, 4 by direct contact with them. It is possible and also advantageous to make the measurements by contactless means by the use of, for example, electromagnetic waves. Also shown in FIG. 1 are pressure-measuring devices 8 or pressure transducers 8, which can measure the pressures in the piston-cylinder units 3, 5. These measurement values can then be used to determine the forces K1, K2 acting on the straightedges 2, 4 by means of known procedures. Alternatively, it is also possible in the case of a drive with a motor 3, 5, especially a rotary motor, to use its drive torque to determine the force acting on the straightedges 2, 4 (see FIG. 3).

Figure 2:
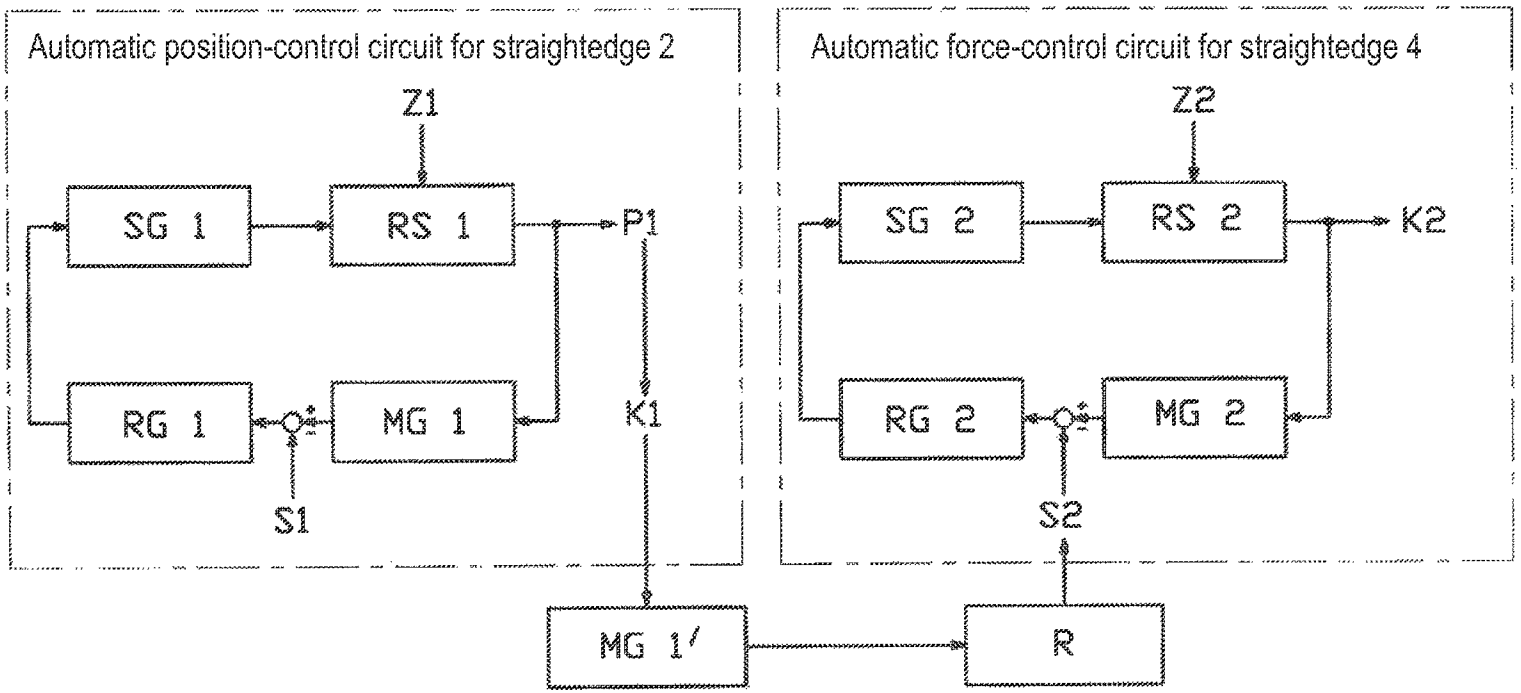
FIG. 2 shows an automatic control diagram.

FIG. 2 shows a schematic diagram of an inventive exemplary embodiment of an automatic control circuit for controlling the lateral guides or straightedges 2, 4. According to the invention, a first straightedge 2 is operated under position control. The control circuit for controlling the straightedge 2 is shown on the left side of FIG. 2. Its controlled system RS 1, i.e., the state of that system, is disturbed by some form of disturbance Z1. Such a disturbance Z1 can be, for example, a force exerted by the metal strip 1 on the straightedge 2. The disturbance causes the straightedge 2 to assume a position such as position P1. This position P1 of the straightedge 2 can be determined by a position sensor 7, which forms the measuring element MG 1 of the automatic position control circuit of the first straightedge 2. Then a check is made to determine whether the measured value of the position of the first straightedge 2 agrees with a nominal value S1 for the position of the first straightedge 2. Then preferably a control element RG 1 or automatic control device RG 1 is provided, which transmits an absolute value for the distance to be traveled by the straightedge 2 into a corrected position. By means of the actuating element SG 1 such as a piston-cylinder unit 3, for example, it is then possible to influence the controlled system RS 1 and thus the position of the straightedge 2. A force K1, furthermore, which acts on the straightedge 2, is also always present for a position value of the straightedge 2 such as the value P1. This force can be measured by a measuring device or measuring element MG 1'. This can be formed by, for example, a measuring device 6 or 8. The straightedge 2 is preferably held in a constant position by the automatic position control system. This means that, in this case, the nominal position S1 is constant.

The second straightedge, namely, straightedge 4, is preferably operated under force control, that is, by means of an automatic force-control circuit such as that shown on the right in FIG. 2. As a result of the pressure of the strip 1 against the straightedge 4, disturbance Z2 acts on the second straightedge 4. Through the action of the disturbance Z2 on the controlled system RS 2 and the pressing force of the straightedge 4 against the metal strip 1, there exists a force K2, i.e., the total force K2 present between the metal strip 1 and the straightedge 4. This force K2 can be determined by a measuring element MG 2. Measurement devices of type 6 or 8, among others, can be used as the measuring element MG 2. In the next step, the measured force K2 is compared with a nominal force S2, and a possible difference is transmitted to the automatic control element RG 2. By means of the control element RG 2, shifting distances are transmitted to an actuator SG 2, which, finally, exerts an effect on the controlled system RS 2. The actuating element SG 2 can again be formed by, for example, a piston-cylinder unit 5 or by an electrical or rotary motor.

The measured force values determined by the measuring element MG 1' on the side of the first, position-controlled straightedge 2 are preferably processed by a controller R or automatic control device R into nominal values for the forces S2 of the automatic control circuit of the second, force-controlled straightedge 4. In other words, this means that the nominal forces S2 of the automatic force-control circuit of the second straightedge 4 are selected as a function of the forces K1 measured on the position-control side. If, for example, a force K1 on the position-controlled straightedge 2 increases, this can be counteracted by decreasing the nominal force S2 on the force-controlled side. If, conversely, the force K1 on the position-controlled side decreases, then preferably the nominal value for the nominal force S2 on the force-controlled side is increased. It is also possible, furthermore, for additional process parameters to be included in this control process such as the material of the strip or other properties of the strip or various mill parameters. If, furthermore, a lower limit for the nominal force S2 on the force-controlled side is selected, then it can be ensured that the control process will always be able in particular to overcome the friction of the strip. It is also possible, and preferable, to filter the forces K1 measured on the position-controlled side through a low-pass filter. The choice of the nominal force S2 for the second straightedge 4 can also be determined, preferably, by way of the equations $F_1=K1-a$ and $S2=b-c\cdot F_1$, where the parameters a, b, c, and d are greater than or equal to zero, and the parameter b is the technologically required maximum pressing force of the second, force-controlled straightedge 4, and where it is also true that $S2\geq d$ and $F_1\geq 0$, where $F_1$ represents an auxiliary variable. This calculation represents an advantageous example of the relationship between the measured forces K1 on the position-controlled side and the nominal forces S2 for the force-controlled side of the control system. In particular, furthermore, the parameters a, c, and d can be selected in such a way that the parameter a represents a prespecifiable minimum force on the first, position-controlled straightedge 2; the prespecifiable parameter c represents the ratio of the relief of the second, force-controlled straightedge 4 in the case of an increase in the force K1 on the first, position-controlled straightedge 2; and the parameter d represents the lower limit force, i.e., the limit below which the force may not fall when the nominal force S2 for the second, force-controlled straightedge 4 is being decreased. Here it should also be emphasized, however, that the choice of these parameters depends on the concrete technical problem and therefore cannot be further specified here. It should also be observed that the preceding description of the control process based on the cited equations represents only one example of the realization of the inventive control process and may not be understood in a limiting fashion.

LIST OF REFERENCE SYMBOLS

1 metal strip
2 first straightedge
3 pressing device
4 second straightedge
5 pressing device
6 force sensor
7 position sensor
8 pressure sensor
9 first guide edge
10 second guide edge
K1 force present at the first straightedge
K2 force present at the second straightedge
MG 1 position sensor for the first straightedge
MG 1' force sensor for the first straightedge
MG 2 force sensor for the second straightedge
P1 position of the first straightedge
R automatic controller for the output of the nominal value of the force S2
RG 1 automatic control element of the first straightedge
RG 2 automatic control element of the second straightedge
RS 1 controlled system of the first straightedge
RS 2 controlled system of the second straightedge
S1 nominal value for the position of the first straightedge
S2 nominal force of the second straightedge
SG 1 actuating element of the first straightedge
SG 2 actuating element of the second straightedge
Z1 disturbance in the position-control circuit of the first straightedge
Z2 disturbance in the force-control circuit of the second straightedge

The invention claimed is:

1. A method for controlling the lateral guides of a metal strip (1), especially at the entrance or exit of rolling stands or in front of drive apparatus, wherein the lateral guides, one of which is located on each side of the metal strip (1), each comprises a straightedge (2, 4) arranged laterally with respect to the metal strip (1), wherein the straightedges (2, 4) are physically moveable independently of each other, and a first straightedge (2) is operated under position control and a second straightedge (4) is operated under force control, and wherein forces of the metal strip (1) acting on the first straightedge (2) and on the second straightedge (4) are measured, wherein the nominal force (S2) for the second, force-controlled straightedge (4) is prespecified as a function of the measured force (K1) on the first, position-controlled straightedge (2), wherein, in the case of an increasing force (K1) on the first, position-controlled straightedge (2), the nominal force (S2) for the second, force-controlled straightedge (4) is decreased and optionally, in the case of a decreasing force (K1) on the first, position-controlled straightedge (2), the nominal force (S2) for the second, force-controlled straightedge (4) is increased.

2. A method according to claim 1, wherein, in the case of an increasing force (K1) on the first, position-controlled straightedge (2), the nominal force (S2) for the second, force-controlled straightedge (4) is decreased to a prespecifiable lower limit.

3. A method according to claim 2, wherein the nominal force (S2) for the second, force-controlled straightedge (4) is determined from the parameters a, b, c, and d and the measured force (K1) on the first, position-controlled straightedge (2) by means of the equations:

$$F_1 = K1 - a, \text{ and}$$

$$S2 = b - c \cdot F_1,$$

where the parameters a, b, c, and d are greater than or equal to zero; the parameter b expresses the necessary maximum pressing force of the second, force-controlled straightedge (4);

and in addition S2≥d and $F_1 \geq 0$, where $F_1$ represents an auxiliary variable.

4. A method according to claim 3, wherein the parameter a expresses a prespecifiable minimum force on the first, position-controlled straightedge (2); the prespecifiable parameter c expresses the ratio of the relief of the second, force-controlled straightedge (4) in the case of an increasing measured force (K1) on the first, position-controlled straightedge (2); and the parameter d represents the lower limit force, i.e., the limit below which the force may not fall when the nominal force (S2) for the second, force-controlled straightedge (4) is being decreased.

5. A method according to claim 1, wherein the forces (K1) measured on the first, position-controlled straightedge (2) are filtered through a low-pass filter.

6. A method according to claim 1, wherein the first and the second straightedges (2, 4) are each driven by a drive (3, 5) and at least one of these drives is optionally either hydraulic or pneumatic.

7. A method according to claim 6, wherein the hydraulic or pneumatic drives (3, 5) each comprise a cylinder chamber, and the forces (K1, K2) acting on the first and second straightedges (2, 4) are determined from the pressures measured in the cylinder chambers.

8. A method according to claim 1, wherein the first and second straightedges (2, 4) are each driven by a drive (3, 5), and at least one of these drives is formed by an electrical linear motor.

9. A method according to claim 8, wherein the force (K1, K2) acting on the first or second straightedge (2, 4) is determined from measured electrical variables of the linear motor.

10. A method according to claim 1, wherein the first and second straightedges (2, 4) are each driven by a drive (3, 5), and wherein at least one of these drives takes the form of a rotary motor and a spindle gear, wherein the rotary motor is driven hydraulically or pneumatically, as desired.

* * * * *